US009745542B2

(12) United States Patent
Kimmel et al.

(10) Patent No.: US 9,745,542 B2
(45) Date of Patent: Aug. 29, 2017

(54) BURNER CUP

(71) Applicant: Lamplight Farms Incorporated, Menomonee Falls, WI (US)

(72) Inventors: Adam S. Kimmel, Union Grove, WI (US); Ron White, North Prairie, WI (US); Richard Catalano, Hartland, WI (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 273 days.

(21) Appl. No.: 14/462,909

(22) Filed: Aug. 19, 2014

(65) Prior Publication Data

US 2015/0049470 A1 Feb. 19, 2015

Related U.S. Application Data

(60) Provisional application No. 61/867,415, filed on Aug. 19, 2013, provisional application No. 61/887,120, filed on Oct. 4, 2013, provisional application No. 62/018,344, filed on Jun. 27, 2014.

(51) Int. Cl.

| | |
|---|---|
| ***F21L 19/00*** | (2006.01) |
| ***C11C 5/00*** | (2006.01) |
| ***F21V 37/00*** | (2006.01) |

(52) U.S. Cl.

CPC ..... *C11C 5/006* (2013.01); *C11C 5/00* (2013.01); *C11C 5/008* (2013.01); *F21V 37/002* (2013.01)

(58) Field of Classification Search

CPC ..... C11C 5/02; C11C 5/006; F21V 37/002

USPC ..... 362/161

See application file for complete search history.

(56) References Cited

U.S. PATENT DOCUMENTS

| | | | | |
|---|---|---|---|---|
| 2,025,845 | A * | 12/1935 | Bernhardt | A24F 15/10 221/149 |
| 2,586,380 | A * | 2/1952 | Quercia | F23Q 2/44 431/323 |
| 2,795,945 | A * | 6/1957 | Coenders | F23Q 2/08 431/136 |
| 4,892,711 | A | 1/1990 | Tendick, Sr. | |
| 5,000,678 | A | 3/1991 | Thompson | |
| 5,127,825 | A | 7/1992 | Tendick, Sr. | |
| 5,807,093 | A * | 9/1998 | Tendick, Sr. | F21L 17/00 431/146 |
| 6,010,333 | A | 1/2000 | Tendick, Sr. | |
| 6,159,002 | A | 12/2000 | LeJeune | |
| 6,780,382 | B2 | 8/2004 | Furner et al. | |
| 6,802,707 | B2 * | 10/2004 | Furner | F23D 3/16 431/292 |
| 6,960,320 | B1 | 11/2005 | Smith et al. | |
| 7,247,017 | B2 | 7/2007 | Furner | |
| 7,287,978 | B2 | 10/2007 | Kubicek et al. | |
| 7,318,724 | B2 | 1/2008 | Kubicek et al. | |
| 7,467,945 | B2 | 12/2008 | Kubicek et al. | |
| D679,048 | S | 3/2013 | White | |
| 8,435,029 | B2 | 5/2013 | Masterson et al. | |
| 8,439,669 | B2 | 5/2013 | Masterson et al. | |
| 8,550,813 | B2 | 10/2013 | Masterson et al. | |

(Continued)

*Primary Examiner* — Ali Alavi

(74) *Attorney, Agent, or Firm* — David G. Woodral; Gable Gotwals

(57) ABSTRACT

A device has a canister with a bulk wick occupying at least most of the canister, and a lid affixed to the canister and in contact with the bulk wick. The lid defines an opening exposing a portion of the bulk wick for lighting.

14 Claims, 13 Drawing Sheets

(56) References Cited

U.S. PATENT DOCUMENTS

| | | | | |
|---|---|---|---|---|
| 2003/0027092 | A1* | 2/2003 | Wolgamuth | F23D 3/24 431/345 |
| 2007/0298360 | A1 | 12/2007 | Ukra | |
| 2009/0068608 | A1 | 3/2009 | Hansen | |
| 2009/0220904 | A1 | 9/2009 | Masterson et al. | |
| 2010/0112503 | A1 | 5/2010 | Masterson | |
| 2010/0112504 | A1* | 5/2010 | Reed | F21V 37/0004 431/320 |
| 2011/0097676 | A1 | 4/2011 | Masterson et al. | |
| 2013/0288186 | A1* | 10/2013 | White | F23D 3/26 431/2 |
| 2013/0288189 | A1 | 10/2013 | White | |
| 2013/0323659 | A1 | 12/2013 | White | |

* cited by examiner

BURNER CUP

CROSS REFERENCE TO RELATED APPLICATIONS

This application claims the priority of U.S. Provisional Patent Application No. 61/867,415, titled "BURNER CUP," filed Aug. 19, 2013, and U.S. Provisional Patent Application No. 61/887,120, titled, "ILLUMINATION SOURCE," filed Oct. 4, 2013, and U.S. Provisional Patent Application No. 62/018,344, titled "SOLID LID BURNER CUP," filed Jun. 27, 2014, the contents of each of which are hereby incorporated by reference.

FIELD OF THE INVENTION

This disclosure relates to the field of fuel burning lamps and burners in general and, more specifically, to products capable of providing enhanced flame effects utilizing low flammability fuel.

BACKGROUND OF THE INVENTION

Candles, lamps, and lanterns have been used for lighting since ancient times. Although modern households rely on electric lighting, the use of these combustion-based devices has never completely subsided. Combusting light implements are used even in modern times as a backup or emergency lighting source, for ambiance, to disperse scents or repellants, for decoration, and for other purposes.

Especially when used outdoors, regular fiber-wicked candles may suffer from inadvertent extinguishment owing to the low quantity of fuel they burn per wick. Larger wicks can produce more robust flames but these can be difficult to control satisfactorily and are often sooty or smoky in appearance. Similar problems may be faced with a liquid fueled apparatus since these are also based on traditional woven wicks. Moreover, in dealing with liquid fueled devices the fuel must usually be stored in an attached reservoir leading to issues of spillage and proper ventilation.

What is needed is a candle holder to address the above limitations.

SUMMARY

The invention of the present disclosure, in one aspect thereof comprises a device having a canister, a bulk wick occupying at least most of the canister, and a lid affixed to the canister and in contact with the bulk wick. The lid defines an opening exposing a portion of the bulk wick for lighting.

The lid may be a mesh lid with a central ring exposing the bulk wick. The lid may be concave into the canister. In some embodiments the lid is solid except for the opening exposing a portion of the bulk wick.

The the bulk wick may define a cavity below the opening in the lid. The cavity may extend to an interior bottom of the canister. In other embodiments, the cavity extends inside the canister to an insulative pad at the bottom of the canister. The cavity may have as a cylindrical wall extending downward through the bulk wick and a lip protruding inwardly from the wall.

The device may further include a woven wick extending from inside the bulk wick through the opening in the lid. In other embodiments, the bulk wick is formed into a plurality of fins extending inwardly from wall of the canister.

The invention of the present disclosure, in another aspect thereof, comprises, a canister having an exterior wall surrounding a canister floor to define a canister interior, a lid for affixing to the top of the canister, and a bulk wick in the canister interior, the bulk wick formed to contact the lid when the lid is affixed to the top of the canister. The lid provides an opening ring defining at least a first burn area for the bulk wick.

In some embodiments the bulk wick contacts the lid only at the opening ring. The bulk wick may define a cavity under the opening ring. The cavity may have a protruding lip providing for ease of lighting. In some embodiments the bulk wick fills the majority of the interior of the canister. The bulk wick may define a fins projecting inwardly from the direction of the exterior wall. An insulative pad may interpose the bulk wick and the canister. Some embodiments comprise a container holding the canister in a supported location.

The invention of the present disclosure, in another aspect thereof comprises a device having a bulk wick of sufficient volume to contain a quantity of liquid fuel for burning, a canister that contains the wick, and a lid that fits onto the canister and provides at least one opening appropriately sized to allow air to enter the canister for mixing with fuel in a combustion process and allowing the combustion products to escape. In some embodiments the bulk wick comprises polycrystalline cotton formed to contact an interior of the canister and the wick while providing a cavity as a burn area.

BRIEF DESCRIPTION OF THE DRAWINGS

Like numbers refer to like parts throughout.

DETAILED DESCRIPTION OF THE PREFERRED EMBODIMENTS

Figure 1:
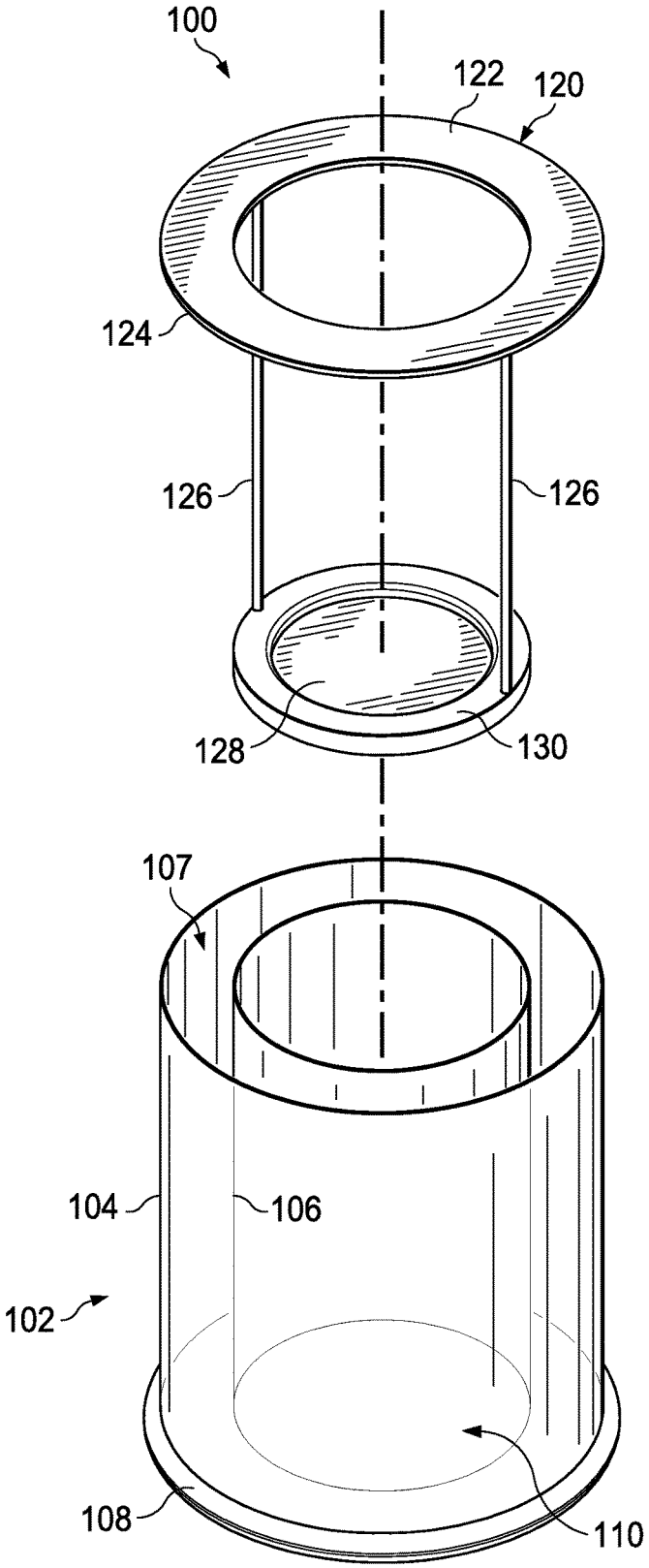
FIG. 1 is a perspective view of a light source holder, container and cap according to aspects of the present disclosure.

Referring now to FIG. 1, a perspective view of a light holder according to aspects of the present disclosure is shown. For purposes of the present disclosure, the term light holder is understood to mean a device that may contain a fuel burning device or other light producing device therein. For example, the light holder 100 may contain various burner cups as described below.

The light holder 100 comprises a container 102. In the present embodiment, the container 102 comprises an outer wall 104 and an inner wall 106. A space 107 is defined between the outer wall 104 and the inner wall 106. In some embodiments, this space 107 will serve as an insulating barrier and, in other embodiments, may be used for decorative purposes, as will be described further below. In the present embodiment, the outer wall 104 and the inner wall 106 connect to the base 108.

In some embodiments, the outer and inner wall 104, 106, will be formed from separate pieces and attached to the base 108. In other embodiments, the outer wall 104 and inner wall 106 may be formed integrally and then attached to the base 108. In some embodiments, the walls 104, 106 will be made from glass. In other embodiments, the walls 104, 106 may comprise some other heat resistant and suitably translucent or transparent material. In some embodiments, a substantially transparent wall design will be utilized to allow for lighting from a candle to shine through the walls and for allowing the candle to backlight decorative items, as will be described more fully below.

The base 108 may provide an opening 110 such that the bottom of the container 102 is open. The base may be made from a metal or plastic or other resilient or durable material. In one embodiment, the walls 104, 106 will be glued to the base 108.

The light holder 100 in the present embodiment also comprises a lid 120. The lid 120 has a top 122 which can be seen as being generally toroidal in shape. In the present embodiment, the top 122 is generally of an open disk shape with a width covering the distance between the outer wall 104 and the inner wall 106. A lip 124 may be formed around the periphery of the top 122 to ensure that the lip 120 is centered on the container 102 when placed thereon. A set of hangers 126 extends generally downwardly from the top 122 and suspends a candle platform 128. The candle platform 128 may also have a lip 130 around a periphery thereof to secure a candle. All of the components of the lid 120 may be metal or suitable heat resistant plastic. The hangers 126 may be a stiff wire that is capable of suspending the base 128 in a level and secure relationship with regard to the top 122.

Figure 2:
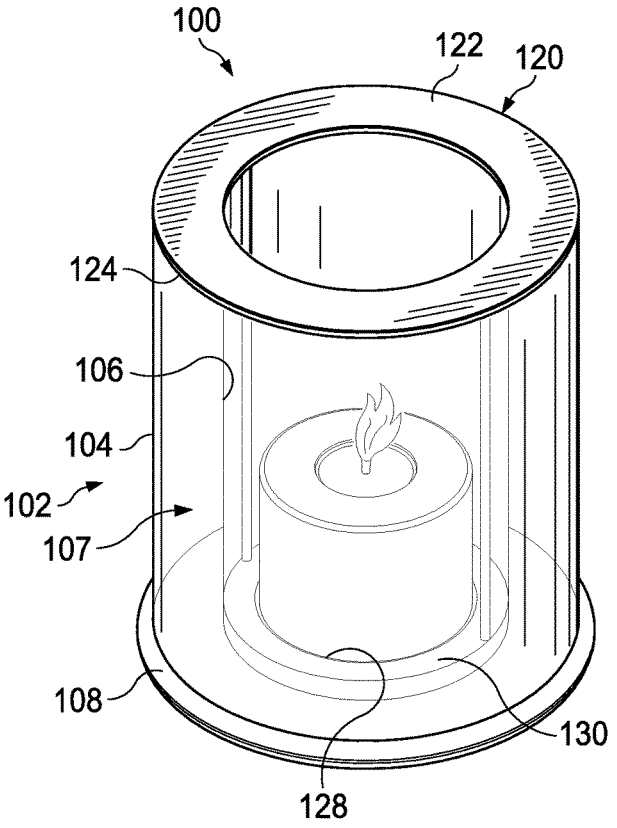
FIG. 2 is a perspective view of the light source holder of FIG. 1 with the cap in place and a light source supported by a platform.

Referring now to FIG. 2, a perspective view of the light holder of FIG. 1 with the cap in place with a candle is shown. Here, the lid 120 is seen in place on the container 102. It can be seen that when the lid 120 is placed upon the container 102, the platform 128 will be at approximately the same level as the base 108 of the container 102. A candle 202 is shown resting on the platform 128. It can be seen that to replace or remove the candle 202, the user need only lift the lid 120. This will allow easy access to the candle platform 128. In this manner, if a candle becomes stuck or melted to the platform 128, it may be easily removed for cleaning It will also be appreciated that, because the walls 104, 106 may be substantially transparent or translucent, any light from the candle 202 will be substantially unimpeded by the candle holder 100. It can be seen that the walls 104, 106 in conjunction with the space 107 therebetween will serve to insulate the user from any heat given off by the candle 202. The light holder 100, as well as other light or candled holders, may be suitable for use with the burner cups of the present disclosure.

Figure 3:
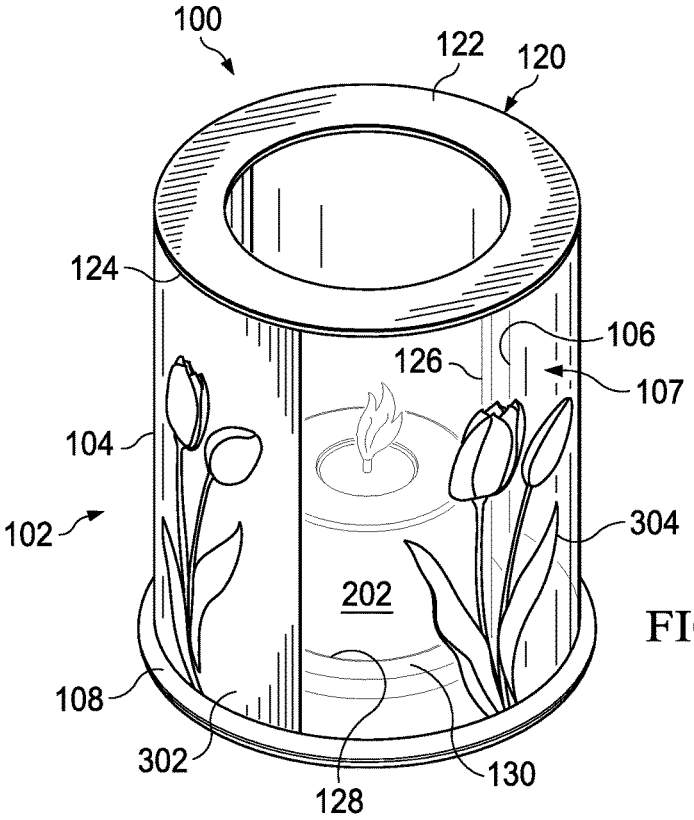
FIG. 3 is a perspective view of the light source holder of FIG. 1 with exemplary decorations.

Referring now to FIG. 3, a perspective view of the light holder of FIG. 1 with exemplary decorations is shown. In the present embodiment, a photograph 302 has been placed within the space 107 between the walls 104, 106. This may be done for decorative or backlighting purposes. The embodiment of FIG. 3 also provides a shadow-type decoration 304 that may be backlit by the candle 202, thereby casting pleasing or decorative shadows. Although only two decorations are shown in FIG. 3, it is understood that number and type of decorations is not meant to be limited by the present disclosure. It will also be appreciated that the design of the candle holder 100 with the lid 120 securely encapsulating the decorations 302, 304 will keep the decorations 302, 304 in relative safety.

Although generally cylindrical or circular walls 104, 106 are used in holder 100, as shown in FIGS. 1-3, other shapes are possible. For example, holder 100 could have an oval cross section. In this way holder 100 would present a broader side when viewed from certain angles. Similarly, square or rectangular cross sections could be employed. In other embodiments, other more complex cross sections could be molded and formed, such star-shaped, or other shapes. The corresponding lids and platforms of these embodiments may be formed to match the shape of the walls such that the holder will operate in substantially the same manner as described with respect to FIGS. 1-3.

Figure 4A:
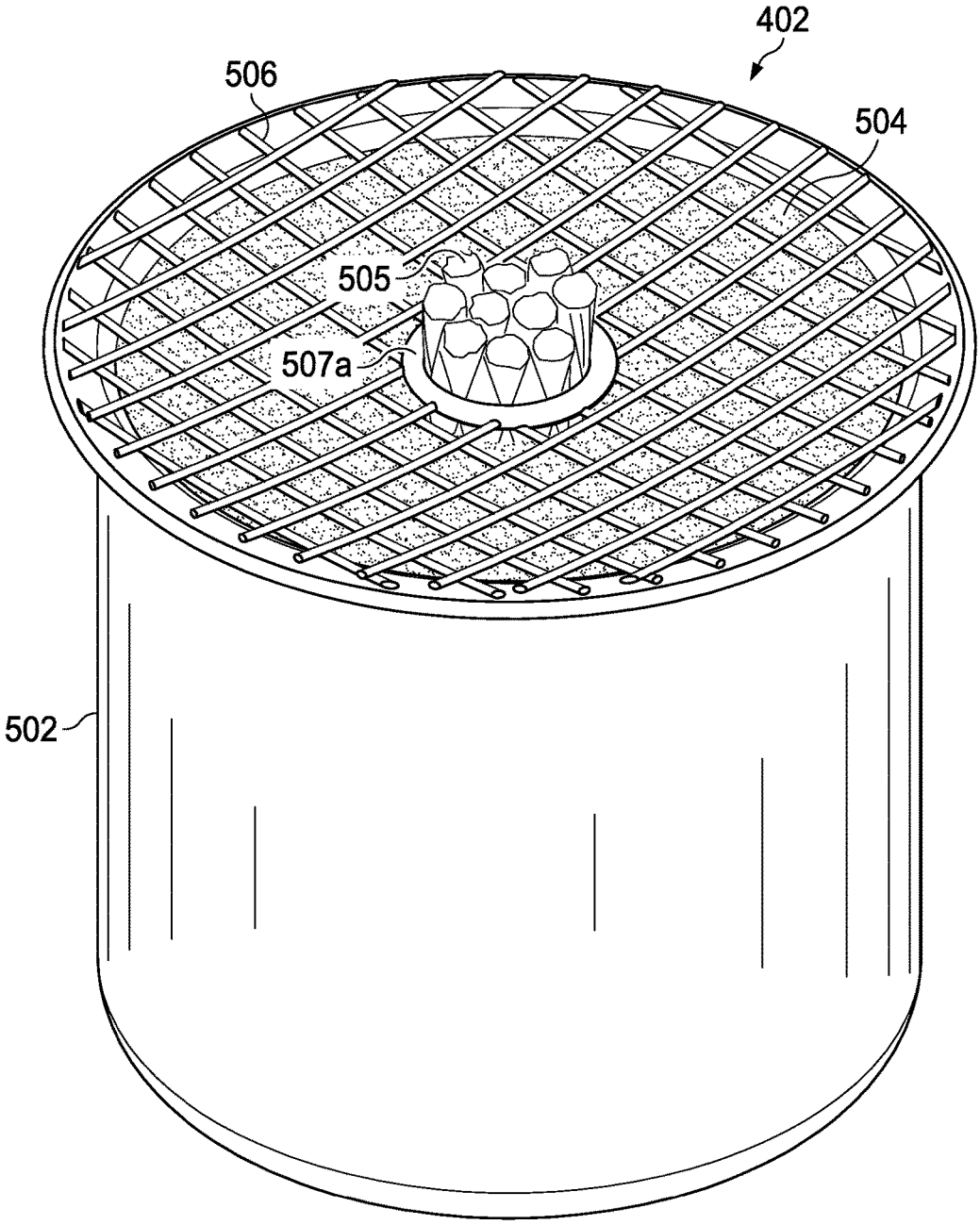
FIG. 4A is a perspective view of one embodiment of a burner cup according to aspects of the present disclosure.

Referring now to FIG. 4A, a perspective view of one embodiment of a burner cup 402 is shown. In one embodiment, the fuel is light and/or whole-cut methyl ester. Other fuels may be utilized and additives may be provided with the fuels to enhance color or flame effects or to provide additional utility such as scents or insect repellency.

Burner cup 402 includes casing 502. The casing 502 may be stainless steel, aluminum, or another suitably heat resistant and resilient material. In one embodiment, the casing 502 is formed from a single piece of steel or other material. The casing 502 may be impermeable to the fuel utilized such that the fuel will not escape even if stored for an extended period of time. A vessel, such as container 102 (e.g., FIGS. 1-3 infra), may be provided to surround or to contain one or more burner cups. As discussed above, container 102 may be decorative. Container 102 may be made of a number of materials including metals, resins, ceramics, and wood, for example. Since the casing 502 is impermeable to fuel, the container 102 need not necessarily also be impermeable.

In the present embodiment, the casing 502 is filled mostly with a wick 504. The wick 504 may be made of polycrystalline cotton (PCC), or may comprise other materials. In one embodiment, wick 504 is made from about 60% to about 90% $Al_2O_3$ and from about 10% to about 30% $SiO_2$. The wick 504 may be formed by wet vacuum processing or molding. The wick 504 may also be cut after forming to achieve desired shape and burn characteristics. An wick that may be shaped or configured into a variety of shapes (e.g., to fit a specific container) is referred to as a bulk wick. A bulk wick may also refer to a wick with amorphous characteristics such that it may be molded, compressed, or cut to fit a particular container.

The wick 504 may be saturated or at least partially imbued or infused with a quantity of fuel sufficient to support a flame on the exposed surfaces of the wick 504, e.g., proximate a top of the casing 502. In one embodiment, a screen 506 covers wick 504. The screen 506 may be stainless steel or another heat resistant material. The screen 506 serves to retain or aid in shaping wick 504 within casing 502. The screen 506 may have a generally concave or convex shape, or may have more complicated geometries.

The wick 504 may be configured in various shapes to control fuel consumption and burn time, to improve flame consistency or to create various flame effects. Such flame effects include, but are not limited to, taller or wider flames, large or smaller flames, and flames that occupy a certain area of the casing 502. The screen 506 provides a solid surface to aid in retaining the wick 504 in a chosen shape. The screen 506 also serves to promote and/or control air flow around the wick 504.

In some embodiments, the screen 506 provides an opening ring 507*a* that provides additional flame modification options. For example, burner cup 402 of FIG. 4A illustrates a standard braided fiberglass wick 505 surrounded by bulk wick 504, and extending through a relatively small ring 507*a*. A high degree of contact may be maintained between the wick 504 and the screen 506 to substantially fill the casing 502 and to secure the fiberglass wick 505 in its location.

Figure 4B:
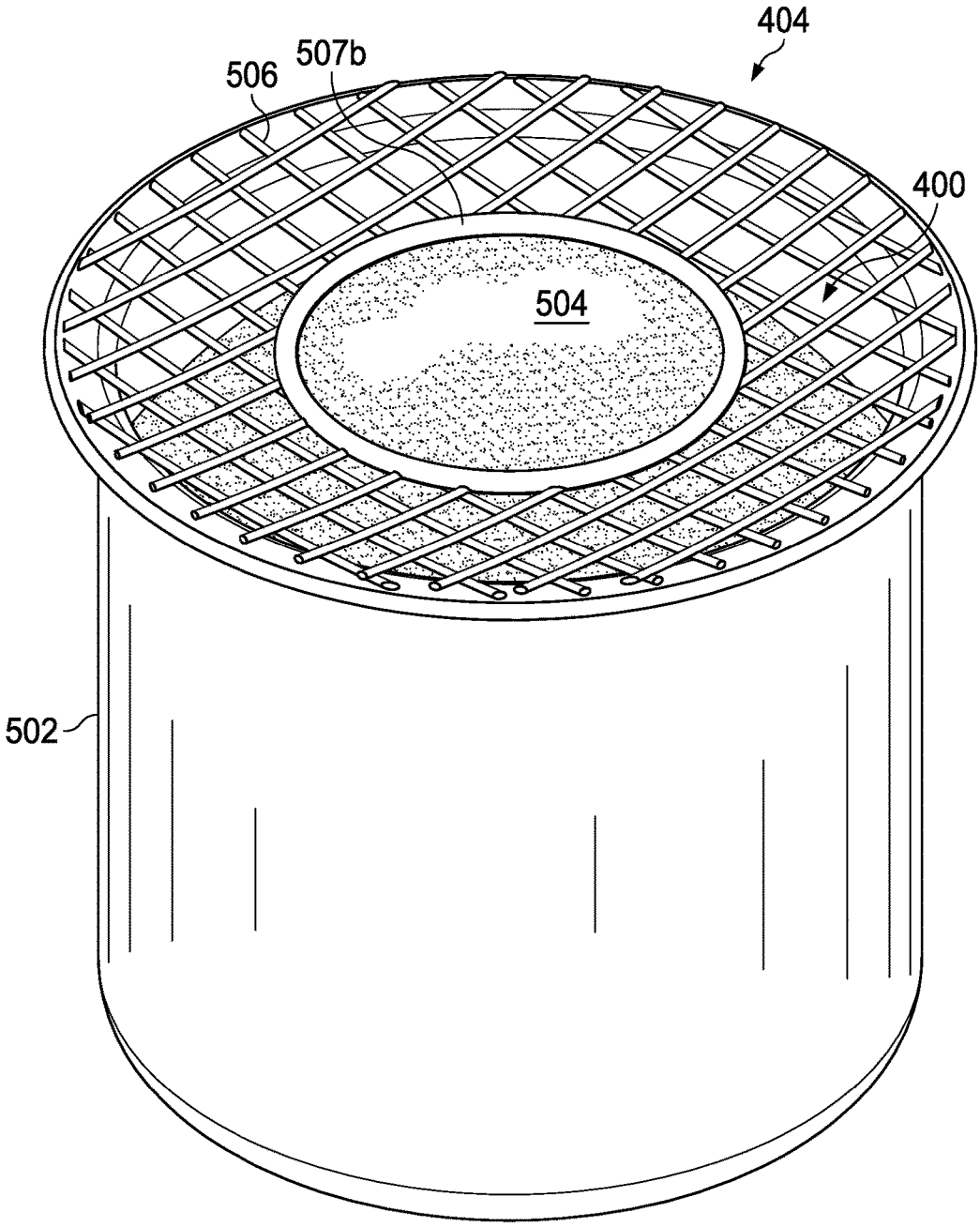
FIG. 4B is a perspective view of one embodiment of a burner cup according to aspects of the present disclosure.

Referring now to FIG. 4B, a perspective view of another embodiment of a burner cup 404 is shown. The burner cup 404 shares some characteristics with the cup 402 discussed above. For example a casing 502 is provided along with a screen 506. Together these components retain a bulk wick 504 therein. Again, the screen 506 may have a dished or concave shape, or could have other shapes. The burner cup 404 has a ring 507*b* that is larger than the ring 507*a* of previously discussed cup 402. In the present embodiment, the lager ring 507*b* provides for a larger surface area of wick 504 to be completely exposed.

As discussed, in order to alter or control burn characteristics, the screen 506 may act to retain the wick 504 in specific shapes. Here a mounded wick area is created in the ring 507*b*. The wick 504 still largely fills the casing 502 but a gap 400 is created between the screen 506 and the wick 504 outside of the ring 507*b*.

Figure 4C:
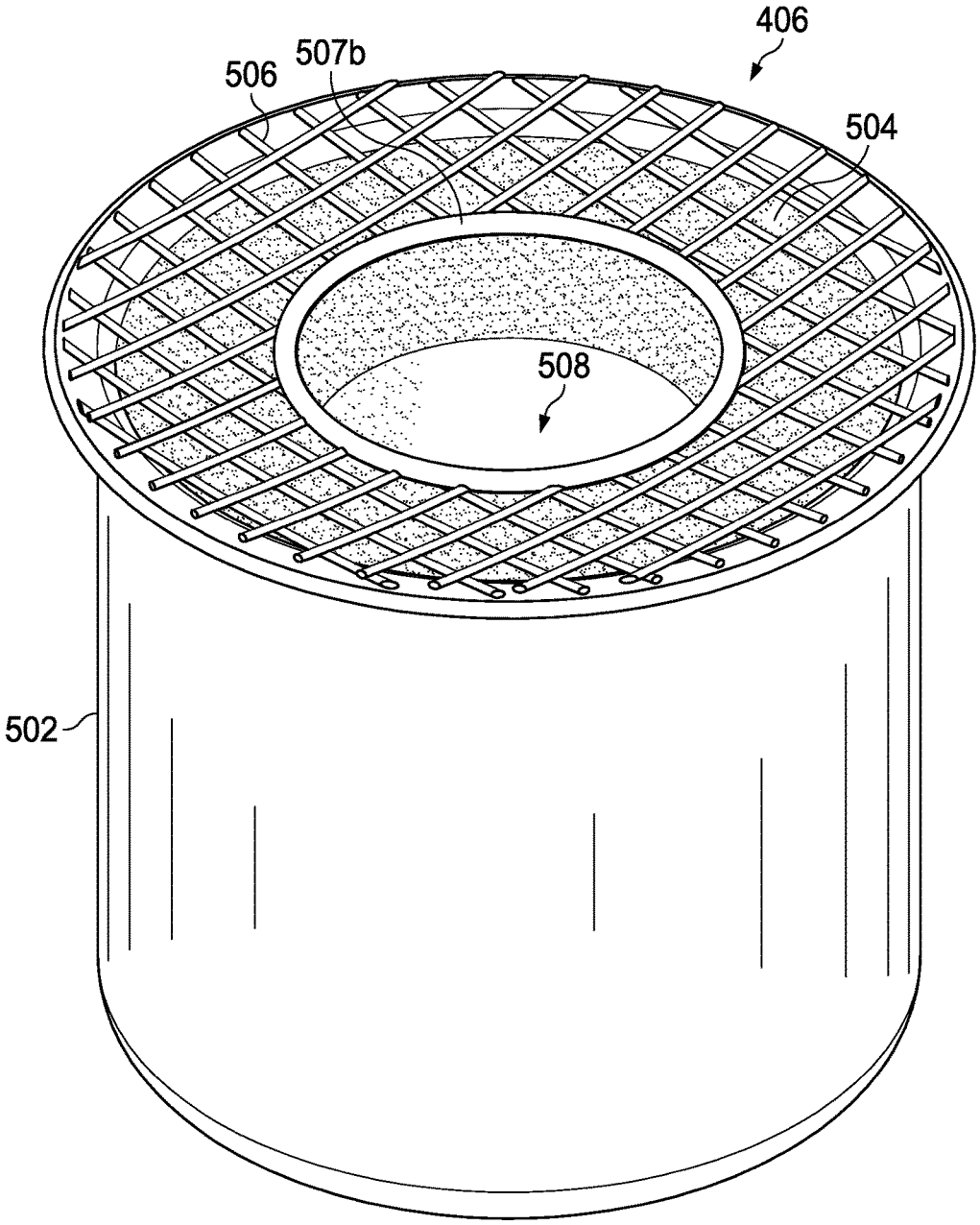
FIG. 4C is a perspective view of one embodiment of a burner cup according to aspects of the present disclosure.

Referring now to FIG. 4C, a perspective view of another embodiment of a burner cup 406 is shown. The burner cup 406 shares some characteristics with the cups 402, 404 discussed above. For example a casing 502 is provided along with a screen 506. Here, a large ring 507*b* surrounds a depression, opening, hole, or cavity 508 defined in the wick 504. The wick 504 otherwise mostly fills the casing 502 up to the level of the screen 506. This configuration allows air to flow easily to a flame emanating from the opening 508 when the cup 406 is operational. Combustion of fuel and/or mixing of fuel with air may take place within the hollowed out portion or cavity 508, which improves fuel utilization and flame consistency Referring now to FIG. 5, a side cutaway view of one embodiment of a burner cup, i.e., burner cup 500, is shown. Burner cup 500 is similar to the burner cups 402, 404, 406 discussed above. The burner cup 500 also provides an insulative pad 510 inside casing 502 near the bottom. The pad 510 insulates the sides and bottom of casing 502, and whatever is below, from excessive heat. The pad 510 may also absorb excess fuel from wick 504, which prevents excess fuel from spilling from the casing 502.

In some embodiments, the pad 510 may also increase the burn time of burner cup 500 as excess fuel may be wicked from the pad 510 into the wick 504 and burned. In one embodiment, there is a single pad 510 in a short cylindrical shape that matches the bottom of casing 502. However, more pads may be provided and/or the pads may have different shapes. For example, a pad may be configured to line all, or substantially all, of the interior wall of the casing 502.

Figure 5:
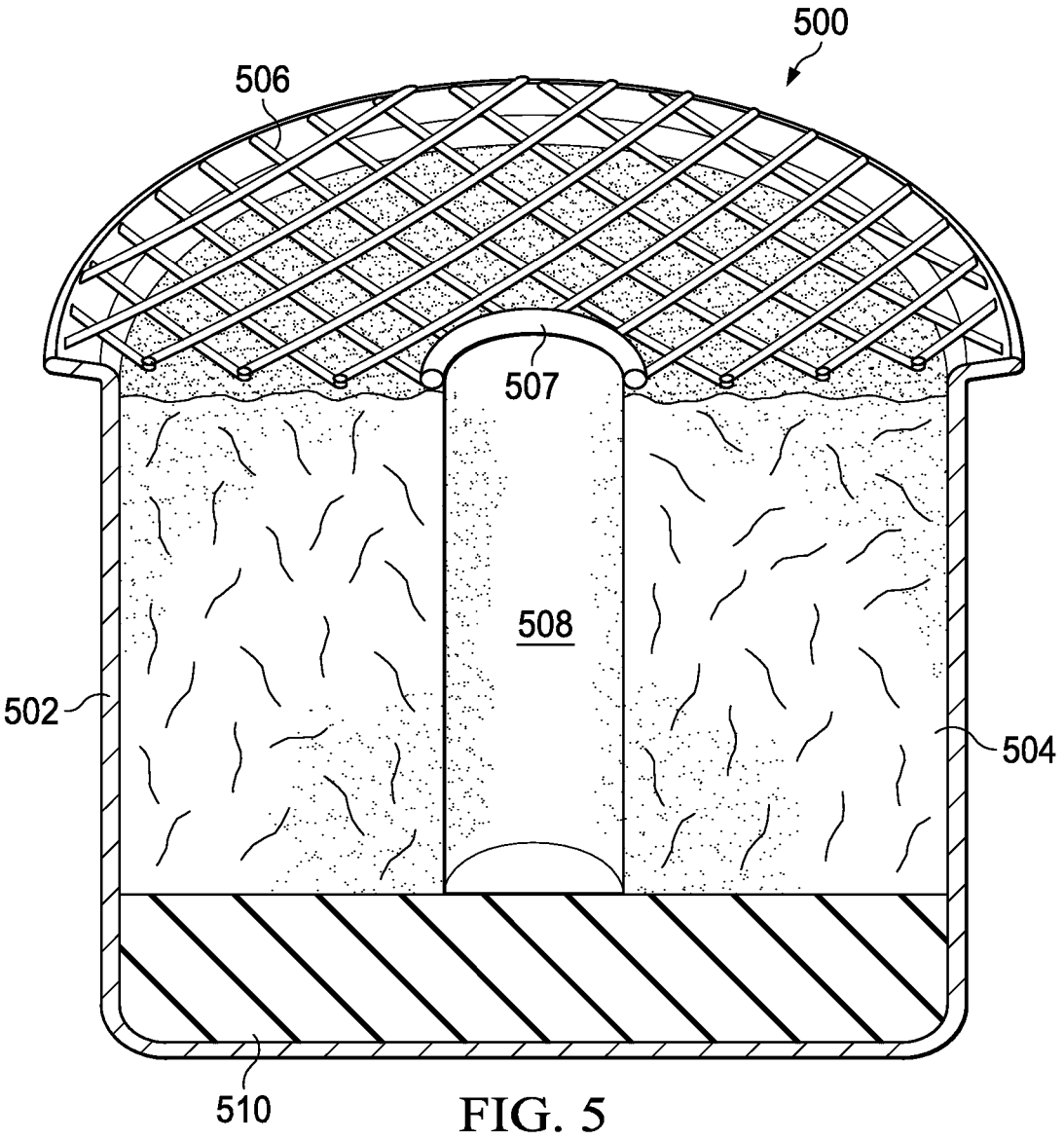
FIG. 5 is a side cutaway view of one embodiment of a burner cup according to aspects of the present disclosure.

The shape and size of any portion of the wick 504 inside casing 502 can vary from that shown. FIG. 5 illustrates a hollowed out portion or cavity 508 that extends all the way to pad 510 such that the wick 504 defines a chimney or tubular shape. However, in other embodiments, the hollowed out portion or cavity 508 may stop short of the pad 510. In other embodiments, the cavity 508 may extend all the way to the bottom of the casing 502, e.g., cavity 508 may extend through pad 510 or no pad 510 is present.

Figure 6:
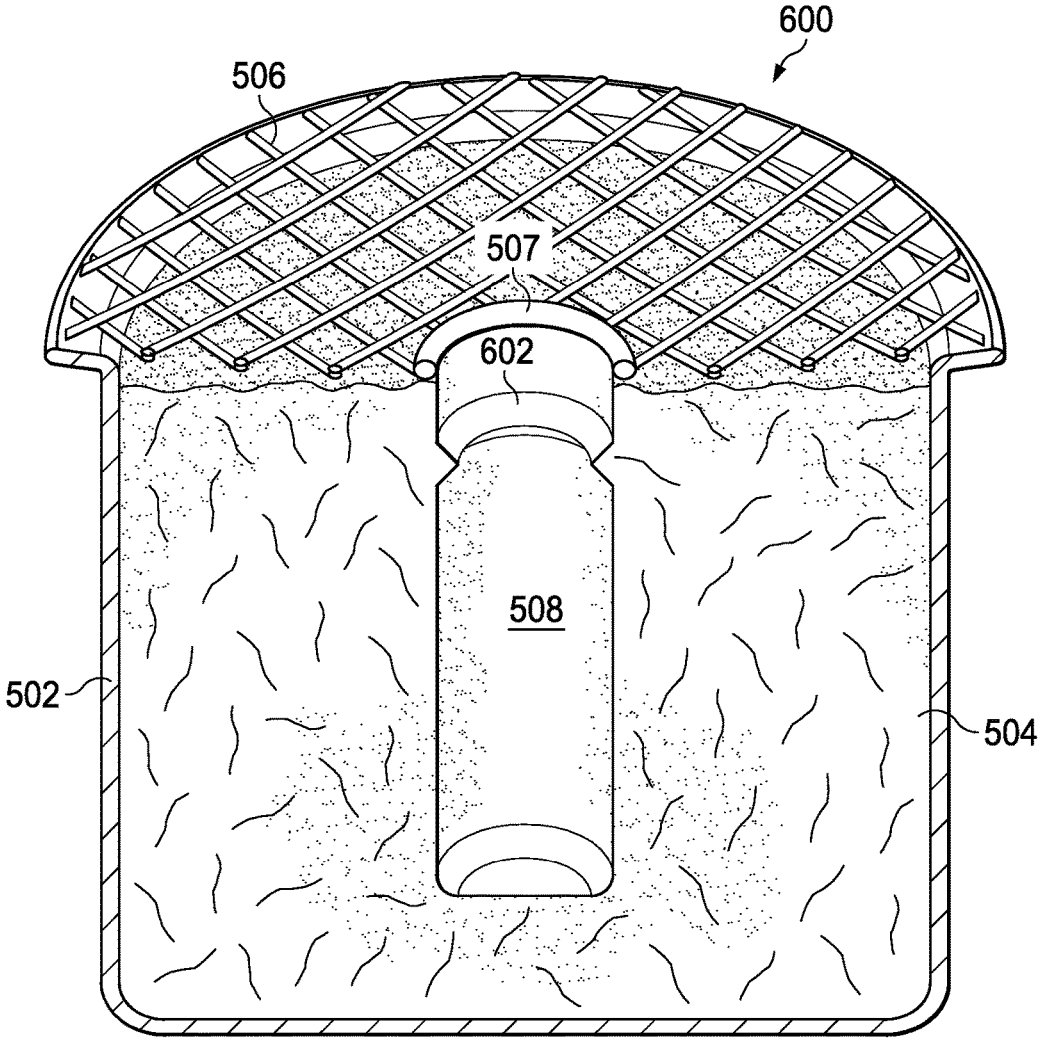
FIG. 6 is a side cutaway view of another embodiment of a burner cup according to aspects of the present disclosure.

Referring now to FIG. 6, a side cutaway view of another embodiment of a burner cup 600 is shown. The burner cup 600 is similar in construction in some ways to those previously described. For example, the burner cup 600 includes a casing 502, which may be cup shaped. A screen 506 may partially cover an upper opening of the casing 502. An opening or ring 507 may be provided in the screen 506 proximate the center of the screen 506. A wick 504 may be provided with a hollowed out portion or cavity 508. As with previous embodiments, the wick 504 may be a bulk wick.

In the present embodiment, a hollowed out portion or cavity 508 does not extend completely to the bottom of the casing 502. A lip or ring 602 circumscribes an interior radius of the hollow portion or cavity 508. The lip or ring 602 may be a shelf-like protrusion extending laterally from the wall of the wick 504 toward the center of the opening 508. The depth of ring 602 in the opening or cavity 508 may be selected to provide a convenient location for lighting wick 504. The lip 602 may serve to demarcate to a user a depth within the opening or cavity 508 providing an ideal depth for ensuring a reliable light of the burner cup 600. In one embodiment, the lip 602 is about 0.5 to 1 inch below the surrounding wick material 504. The location of the lip 602 may be tailored to the specific fuel and wick combination being employed.

Figure 7:
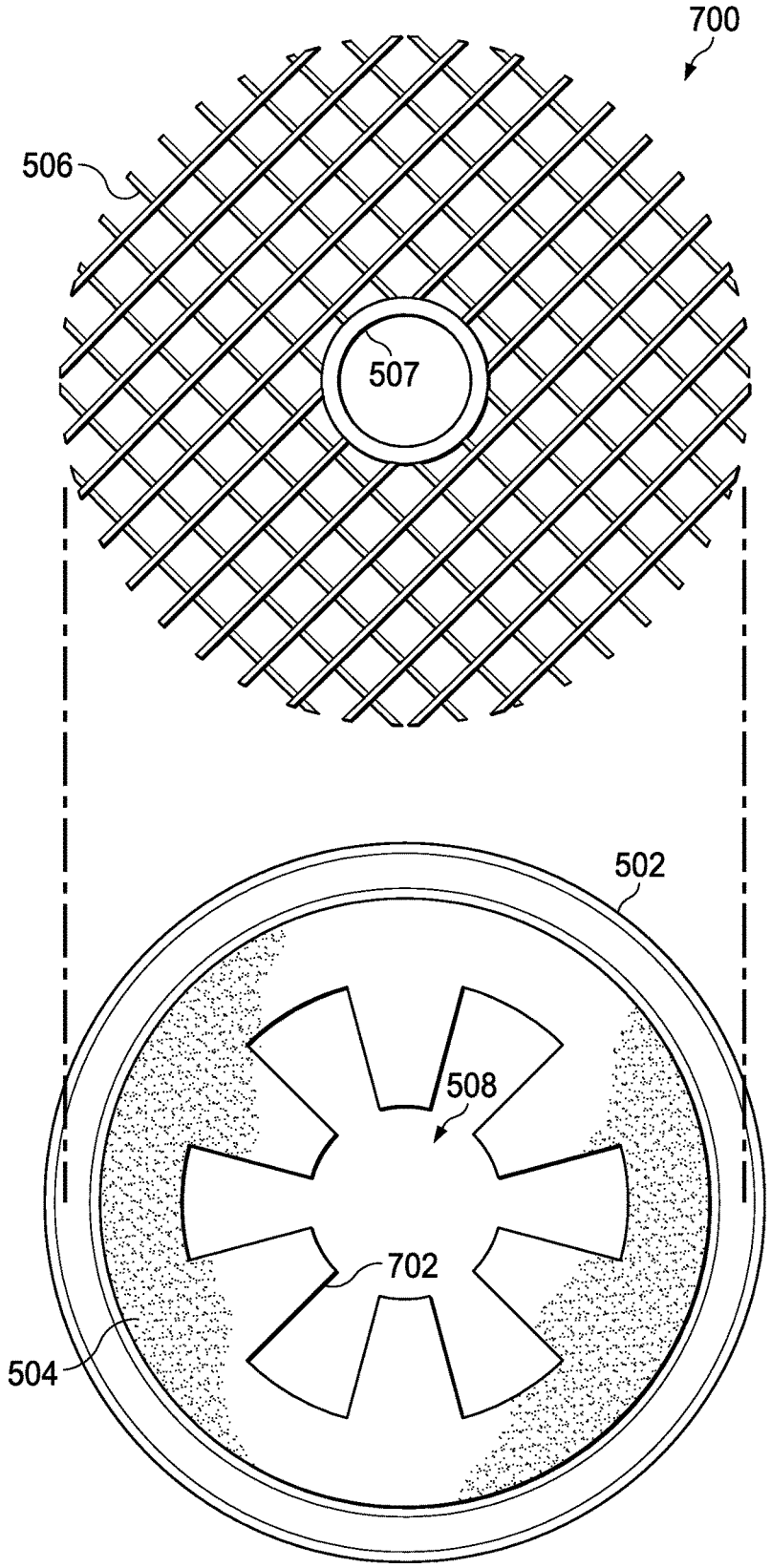
FIG. 7 is a top down view of another embodiment of a burner cup according to aspects of the present disclosure.

Referring now to FIG. 7, a top down view of another embodiment of a burner cup 700 is shown. Burner cup 700 shares some similarities with those previously discussed. The burner cup 700 has a cup shaped casing 502 surrounding a PCC based bulk wick 504 defining an opening or cavity 508. A screen 506 is provided over the top of the casing 502. For purposes of illustration, the screen 506 is shown removed in FIG. 7.

In the embodiment of FIG. 7, the wick 504 provides a series of radially arranged vertical fins 702 protruding toward the center of the opening or cavity 508. The fins 702 may comprise the same material as wick 504. Vertically, fins 702 may extend the entire depth of the opening or cavity 508. The fins 702 operate to promote air flow and ease of lighting for the user. The fins 702 provide additional opportunity for vaporization and burning of the fuel contained with wick 504 and/or casing 502. The screen 506 may be placed atop the casing 502 such that one or more of the fins 702 are accessible for lighting via the opening or cavity 508. In some embodiments, the ring 507 and/or fins 702 may be sized such that fins 702 protrude into the area directly beneath ring 507.

Figure 8:
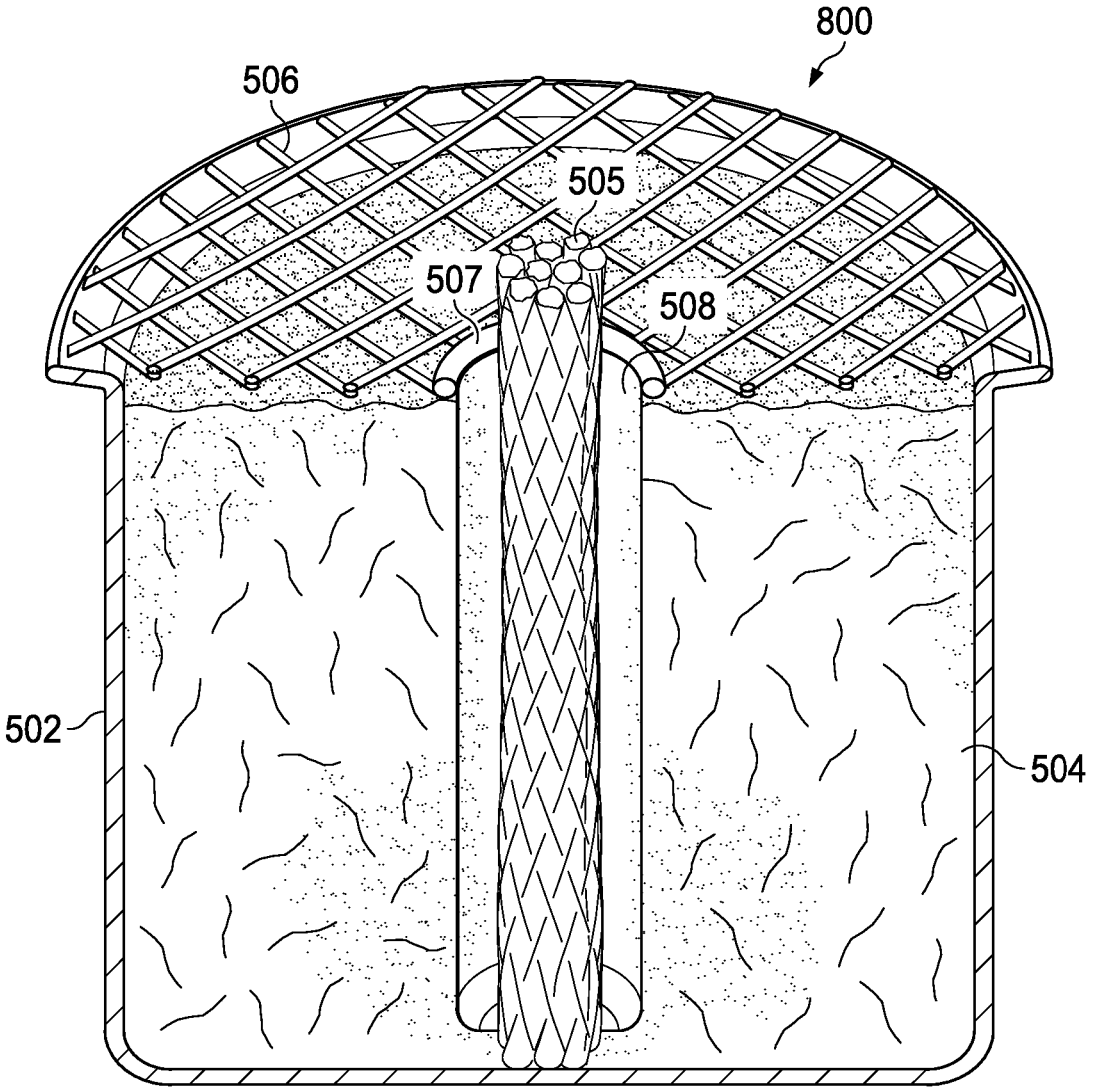
FIG. 8 is a side cutaway view of another embodiment of a burner cup according to aspects of the present disclosure.

Referring now to FIG. 8, a side cutaway view of another embodiment of a burner cup 800 according to aspects of the present disclosure is shown. Burner cup 800 is similar to those previously described. Casing 502 has a cup-like shape with an open top. Within the casing 502 is a bulk wick 504. The wick 504 may retain a quantity of fuel for burning in cup 800. In the present embodiment, a traditional wick 505 (e.g., a braided fiberglass wick), is centered in an opening or cavity 508 in the Bulk wick 504. During operation, the traditional wick 505 draws fuel from bulk wick 504 for combustion near the top of casing 502. The screen 506 defines an opening 507 through which the wick 505 may pass. In some embodiments, the opening 507 serves to locate the upper end of the wick 505 in proper orientation.

Figure 9:
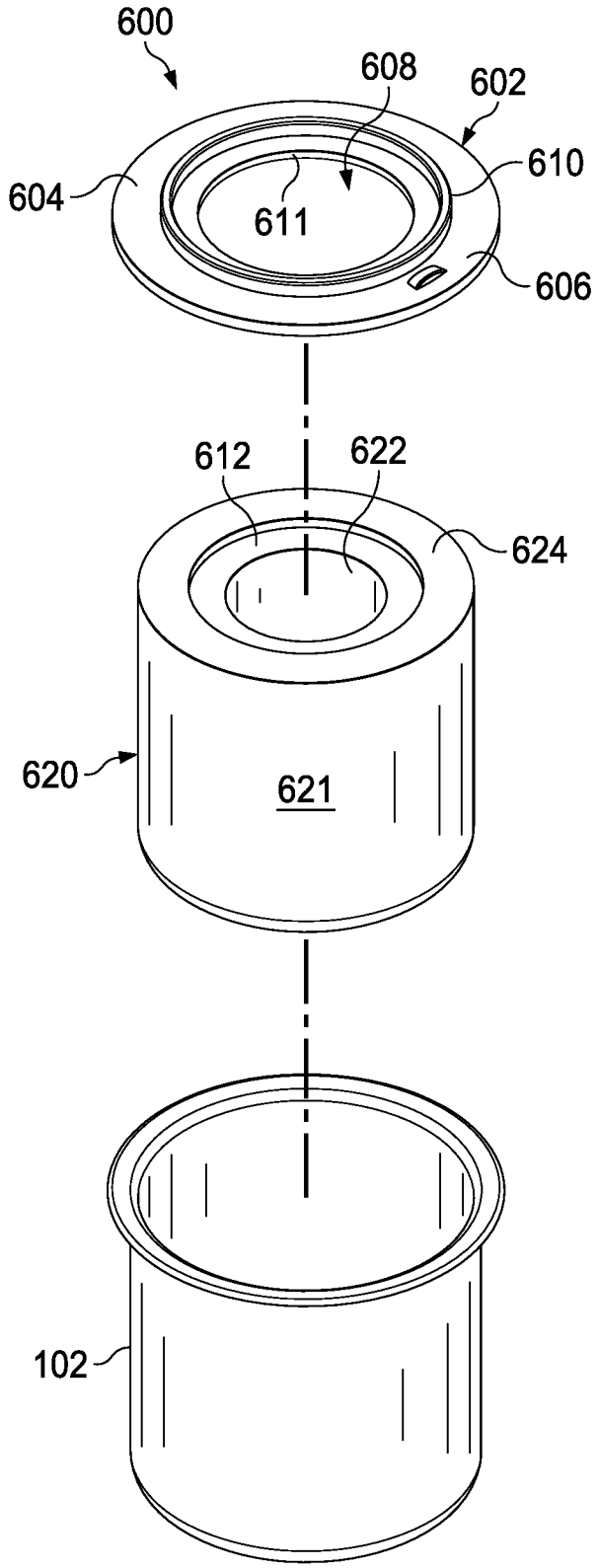
FIG. 9 is an exploded perspective view of another embodiment of a burner cup according to aspects of the present disclosure.

FIG. 9 is an exploded view of another embodiment of a burner cup 600 according to aspects of the present disclosure. The burner cup 600 includes a solid cover 602 (in contrast with the screen covers utilized with previous embodiments). The cover 602 comprises an upper surface 604 and a lower surface 606. Each of the upper and lower surfaces 602, 606 may have a specific contour or surface shape, and these may be the same or different. An inner opening 608 is defined through both the upper and lower surfaces 602, 606 such that the opening 608 is all the way through the cover 602. In the present embodiment, a ridge 610 surrounds the opening 608 to increase structural rigidity. The ridge 610 may also be useful for locating a snuffer (not shown) when used to extinguish the burner cup 600. In some embodiments, the cover 602 is formed from a single sheet of stamped or pressed metal alloy such that the upper surface 604 mirrors the lower surface 606. The opening 608 may be framed by a lip or roll 611.

The burner cup 600 provides a wick 620, which may be a bulk wick. The wick 620 provides a cylindrical body 621 with an opening 622 that goes at least partway through the body 621. An upper surface 624 of the body 621 may have a contour that at least partially corresponds to the lower surface 606 of the cover 602.

The wick 620 is placed into the casing 102 and the cover 602 is placed atop the casing during assembly of the burner cup 600. In some embodiments, the cover 602 is permanently affixed to the casing 102; as the wick 620 may last the life of the burner cup 600, and the opening 608 allows for replenishment of the fuel in the wick 620 without disassembling the burner cup 600.

Figure 10:
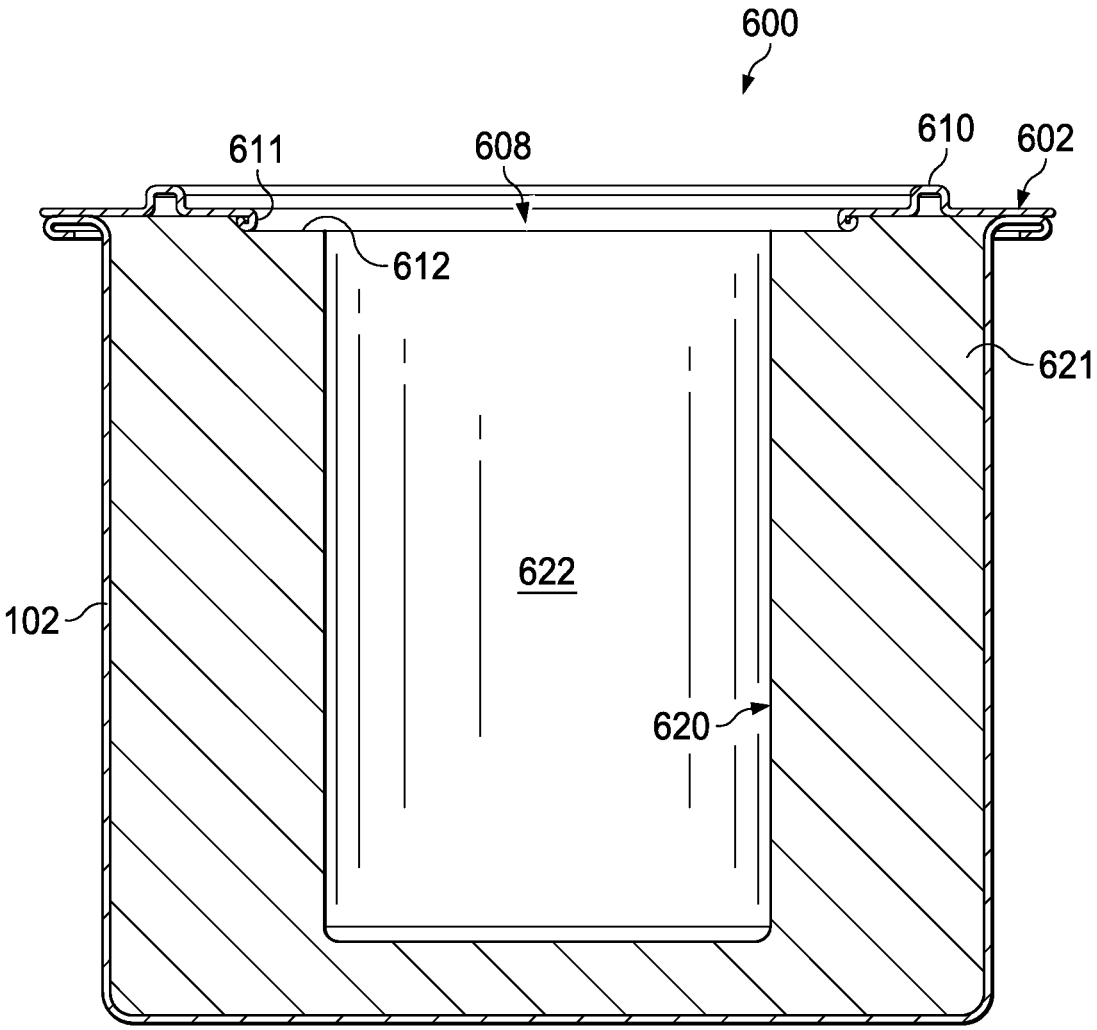
FIG. 10 is a side cutaway view of the burner cup of FIG. 9.

Referring now to FIG. 10, a side cutaway view of the burner cup 600 is shown. Here the burner cup 600 is fully assembled with the wick 620 placed within the casing 102 and the cover 602 affixed to the casing 102 holding the wick 620 in place. The cover 602 may be rolled or folded about the top rim of the casing 102 or may be affixed in some other manner (e.g., spot welding or adhesives). It can be seen that the shape of the outside of the wick body 621 generally comports with the shape of the inside of the casing 102. In some embodiments, the wick body 621 is designed to fill the casing 102 up to the level of the cover 602 (except where the hole or opening 622 is defined in the wick 620). In the present embodiment, the opening 622 does not extend all the way through the body 621 to the inside of the casing 102 but has a layer of material covering the bottom of the inside of the casing 102. In some embodiments, good performance is obtained in terms of wicking and burn characteristics where the bottom layer is between 0.25 inches and 0.5 inches thick.

In operation, the wick 620 is imbued with a quantity of fuel and ignited at the opening 608. Fuel at the surface of the opening 622 burns with a flame produced in the opening 620 and/or opening 608. In order to promote ease of lighting and/or ensure adequate fuel supply, a portion of the upper surface 624 of the body 621 forms a shelf 612 around the opening 622. The shelf 612 may be at the same or a different height than the remainder of the upper surface 624. In the current embodiment, the shelf 612 is slightly depressed relative to the remainder of the supper surface 624 and is bounded by a rim 611 circumscribing the opening 608 in the cover 602. The rim 611 may comprise a part of the lower surface 604 of the cover 602 that contacts the upper surface 624 of the wick body 621 to secure the wick 620 in place in the casing 102.

In one embodiment, the casing 102 of the burner cup 600 is about 2.8 inches tall. The cover 602 has a diameter of about 3.4 inches while the opening 608 is about 2.0 inches in diameter. The opening 622 in the wick body 621 is about 1.5 inches in diameter, which means the shelf 612 is about 0.25 inches across where exposed around the opening 622.

The diameter of the opening 608 in the cover 602 may be from about 50% to about 60% of the diameter of the ridge 610. The height of the casing 102 may be about the same dimension as the overall width. These parameters promote desirable burn and fuel consumption characteristics. The configuration 600 with the solid lid 602 provides more consistent flame throughout the entire burn cycle without a significant decrease in fuel consumption.

The opening 608 is round in the present embodiment, but other shapes are possible. So similar shapes other than cylindrical may be used for the casing 102. However, the rounded or cylindrical embodiments shown promote desirable fuel consumption and flame characteristics.

Figure 11:
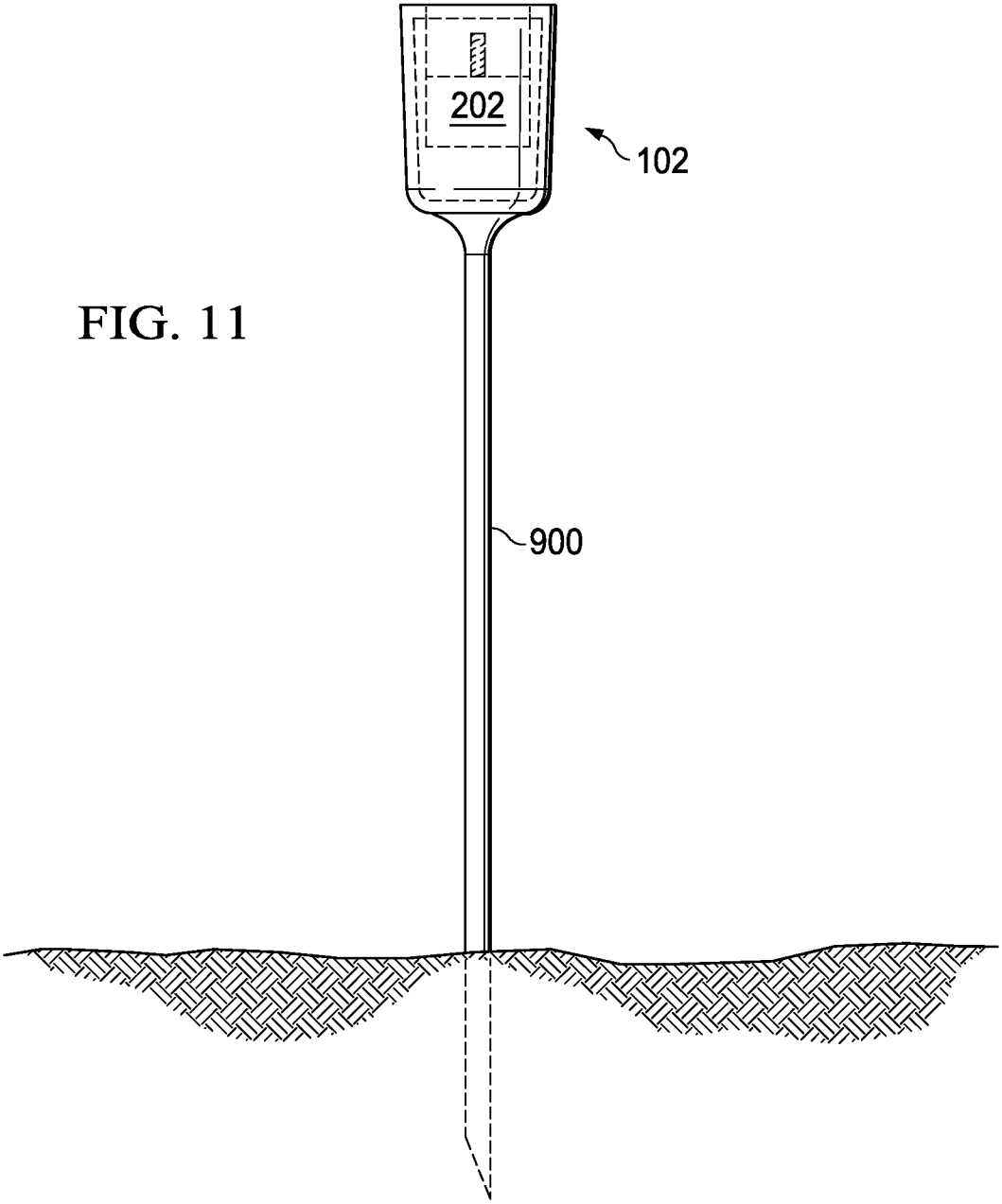
FIG. 11 is an elevation view of the container of FIG. 1 enclosing a burner cup and mounted on a rod.

Referring now to FIG. 11, shown is container 102 mounted on top of torch pole or rod 900. A light source, such as one of the burner cups described above, is mounted within container 102. The elevated container more efficiently illuminates the surrounding area. Rod 900 may be firmly affixed within ground surface 906.

Figure 12:
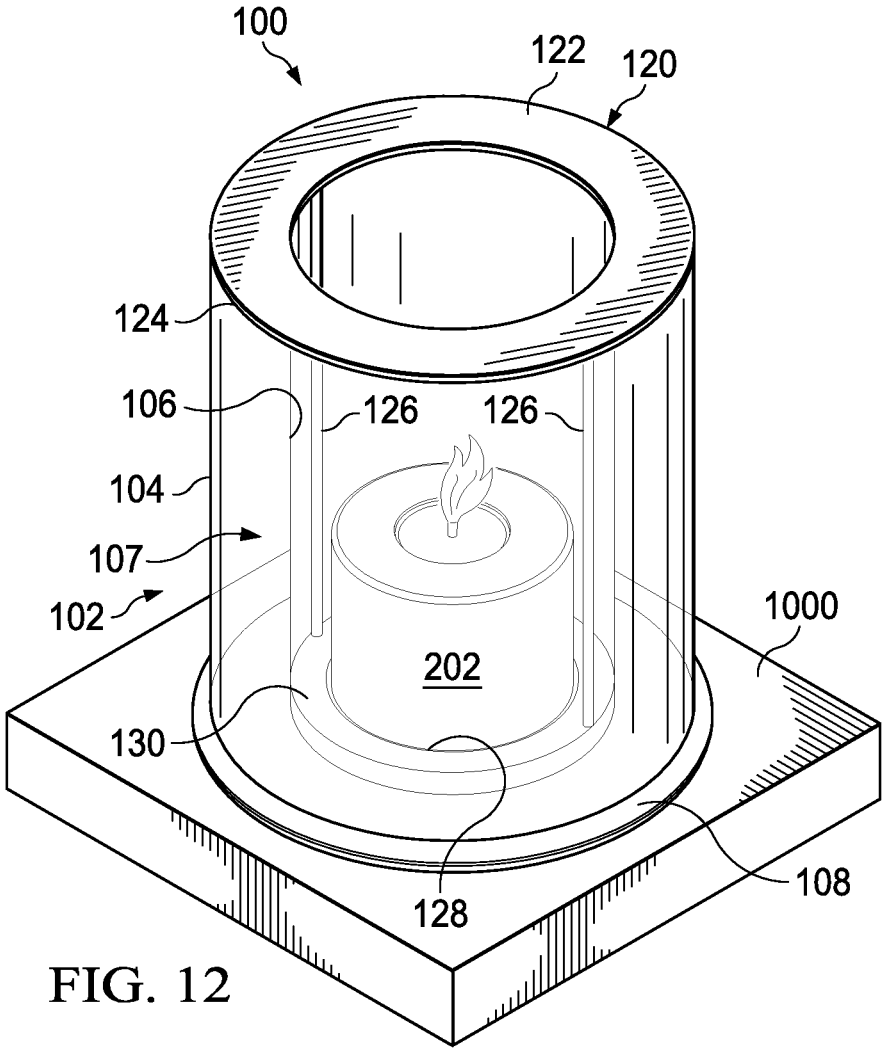
FIG. 12 is a perspective view of the container of FIG. 1 enclosing a burner cup and mounted on a base suitable for locating on a table top.

FIG. 12 shows container 102 mounted on base 1000. A light source, such as a burner cup described above is mounted within container 102. The container 102 and base 1000 combination is suitable for locating on a table top or other surface for providing a convenient source of illumination, scent dispersal, insect repellence, etc. It will be appreciated that the container 102, the rod 900, and/or the base 1000 provide a supported and safe location to utilize the various burner cups of the present disclosure.

* * * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A device comprising:

a canister;

a bulk wick occupying the canister and defining an opening into the bulk wick inside the container; and a lid affixed to the canister and in contact with the bulk wick;

wherein the lid defines an opening exposing a portion of the bulk wick proximate the opening in the bulk wick for lighting of the bulk wick;

wherein the bulk wick defines a cavity below the opening in the lid; and wherein the cavity extends inside the canister to an insulative pad at the bottom of the canister.

2. The device of claim 1, wherein the lid is a mesh lid with a central open ring exposing the bulk wick.

3. The device of claim 2, wherein the lid is concave into the canister.

4. The device of claim 1, wherein the lid is solid except for the opening exposing a portion of the bulk wick.

5. The device of claim 1, wherein the cavity has a cylindrical wall extending downward through the bulk wick and a lip protruding inwardly from the wall.

6. The device of claim 1, further comprising a woven wick extending from inside the bulk wick through the opening in the lid.

7. The device of claim 1, wherein the bulk wick is formed into a plurality of fins extending inwardly from wall of the canister.

8. A device comprising:

a canister having an exterior wall surrounding a canister floor to define a canister interior;

a lid that affixes to the top of the canister;

a bulk wick in the canister interior, the bulk wick formed to contact the lid when the lid is affixed to the top of the canister; and a container holding the canister in a supported location;

wherein the lid provides an opening ring defining at least a first burn area for the bulk wick.

9. The device of claim 8, wherein the bulk wick fills the majority of the interior of the canister.

10. The device of claim 8, wherein the bulk wick defines a fins projecting inwardly from the direction of the exterior wall.

11. The device of claim 8, further comprising an insulative pad interposing the bulk wick and the canister.

12. The device of claim 8, wherein the bulk wick contacts the lid only at the opening ring.

13. The device of claim 8, wherein the bulk wick defines a cavity under the opening ring.

14. The device of claim 13, wherein the cavity has a protruding lip providing for ease of lighting.

* * * * *